US008573890B2

(12) United States Patent
Gehring

(10) Patent No.: US 8,573,890 B2
(45) Date of Patent: Nov. 5, 2013

(54) MARINE POWER GENERATOR DEPLOYMENT AND RETRIEVAL SYSTEM

(76) Inventor: Donald H Gehring, Houston, TX (US)

( * ) Notice: Subject to any disclaimer, the term of this patent is extended or adjusted under 35 U.S.C. 154(b) by 256 days.

(21) Appl. No.: 13/192,427

(22) Filed: Jul. 27, 2011

(65) Prior Publication Data

US 2012/0027524 A1 Feb. 2, 2012

Related U.S. Application Data

(60) Provisional application No. 61/367,991, filed on Jul. 27, 2010.

(51) Int. Cl.

| | |
|---|---|
| ***E02D 23/00*** | (2006.01) |
| ***E02D 27/24*** | (2006.01) |
| ***E02D 29/00*** | (2006.01) |
| ***E21B 17/01*** | (2006.01) |
| ***E02B 17/00*** | (2006.01) |
| ***E02B 9/00*** | (2006.01) |

(52) U.S. Cl.

USPC ..... 405/195.1; 405/201; 405/75; 414/137.7; 414/138.8; 414/139.6; 104/127; 104/128; 104/129

(58) Field of Classification Search

USPC ..... 414/137.7, 138.8, 139.6; 104/127, 128, 104/129; 405/195.1, 201, 75

See application file for complete search history.

(56) References Cited

U.S. PATENT DOCUMENTS

| | | | | |
|---|---|---|---|---|
| 3,756,433 | A * | 9/1973 | Richins | 414/266 |
| 3,993,011 | A * | 11/1976 | Garland | 414/137.7 |
| 6,733,208 | B2 * | 5/2004 | Stockstill | 405/169 |

FOREIGN PATENT DOCUMENTS

WO WO 2006125959 A1 * 11/2006

* cited by examiner

*Primary Examiner* — John Kreck
*Assistant Examiner* — Edwin Toledo-Duran
(74) *Attorney, Agent, or Firm* — Sinorica, LLC

(57) ABSTRACT

An offshore structure for deploying and retrieving underwater electrical power generators that converts energy derived from water currents into electrical energy. The offshore structural platform includes a pair of vertical guide rails to guide a propulsion device lowering said generator underwater onto a seabed propulsion device. The seabed propulsion device is engaged on an underwater seabed rail system and transports the generator onto one of many unique frames specifically designed to support underwater generators. Securing devices are utilized to ensure the generators remain anchored to each propulsion device and to the unique frame. Rail transferring elements are also utilized for a smooth and safe transition during the transport process.

20 Claims, 6 Drawing Sheets

MARINE POWER GENERATOR DEPLOYMENT AND RETRIEVAL SYSTEM

The current application claims a priority to the U.S. Provisional Patent application Ser. No. 61/367,991 filed on Jul. 27, 2010.

FIELD OF THE INVENTION

The present invention relates generally to an underwater electrical power generator deployment and retrieval system. More specifically, the present invention relates generally to a generator deployment and retrieval system that allows marine power generators to be deployed into the water or retrieved from the underwater.

BACKGROUND OF THE INVENTION

The demand for energy is increasing as more and more countries become developed. The search for alternative sources for generating power is stronger than ever. Geothermal, wind, solar, and hydro are just few of many different forms of alternative energy sources that are aimed to reduce undesired byproducts of the burning of fossil fuels, such as carbon monoxide. Marine current power is just one of many sources of alternative power generation. Advantages of using marine currents as a source of energy includes: the reliability of constantly moving marine currents; the high density of water vs. air resulting in reduced turbine blade diameters for similar power output; almost no visual pollution; no environmental impact even for large scale electricity generation operations, and usually a short distance for the marine-current-power generators to the existing electrical grid. Marine power provides a clean, practical, and renewable large scale electrical power and needs different supportive technologies. The present invention aims to deploy and retrieve marine power generators in a more efficient, safe, and cost-effective manner. Currently, the deployment and retrieval of marine power generators is a difficult and dangerous operation due to the large forces of waves and currents imposed on the generators during deployment and retrieval. Resultantly, people involved in the marine power generator deployment and retrieval processes could be badly injured or even killed, especially if safety precautions are not implemented. Also, marine power generators can be damaged or even lost during deployment and retrieval. The present invention allows users to safely and securely deploy and retrieve marine power generators during mild environmental conditions, adding safety and ease to the task.

SUMMARY OF THE INVENTION

It is an aspect of the present invention to provide an offshore power generator deployment and retrieval system that can safely and efficiently deploy and retrieve marine power generators.

It is a further aspect of the present invention to provide an offshore power generator deployment and retrieval system that includes an offshore site structure, a pair of vertical guide rails mounted to the side of the offshore site structure; a seabed guide rail system connected to vertical guide rail system on the seabed; separate locations for each individual offshore power generators called "parking spaces" that extend from the seabed guide rail system; vertical and seabed propulsion devices, to transport power generators onto the seabed; rail transfer elements, as a means to transfer the marine power generator between guide rails and parking spaces; securing devices that safely prevent the power generators from accidently detaching due to strong currents; and one or more cranes, to lift generators off their transport barges and onto the deck and to lower them and retrieve them.

In accordance with a first aspect of the present invention, a novel marine power generator deployment and retrieval system is provided. The novel marine power generator deployment and retrieval system includes an offshore site structure; rail systems connected to the offshore site structure; and propulsion devices, as means to transport the marine powered generators onto the seabed.

In accordance with yet a further aspect of the present invention, a novel marine power generator deployment and retrieval system is provided. The novel marine power generator deployment and retrieval system includes an offshore site structure comprising at least one deck; a vertical guide rail system mounted to a lateral face of the offshore site structure; a seabed guide rail system connected to the pair of vertical guide rails; parking spaces extending from the seabed guide rail system; propulsion devices, to deploy the power generators to their parking space or to retrieve the power generators for maintenance; rail transfer elements, as a means to transfer the power generators between guide rails and parking spaces; at least one jacket; and at least one crane to lift or lower generators off or on to their transport barges and off or onto the deck and to lower or raise the generators into or out of the water using the guide rail system.

DETAIL DESCRIPTIONS OF THE INVENTION

All illustrations of the drawings are for the purpose of describing selected versions of the present invention and are not intended to limit the scope of the present invention.

Figure 1:
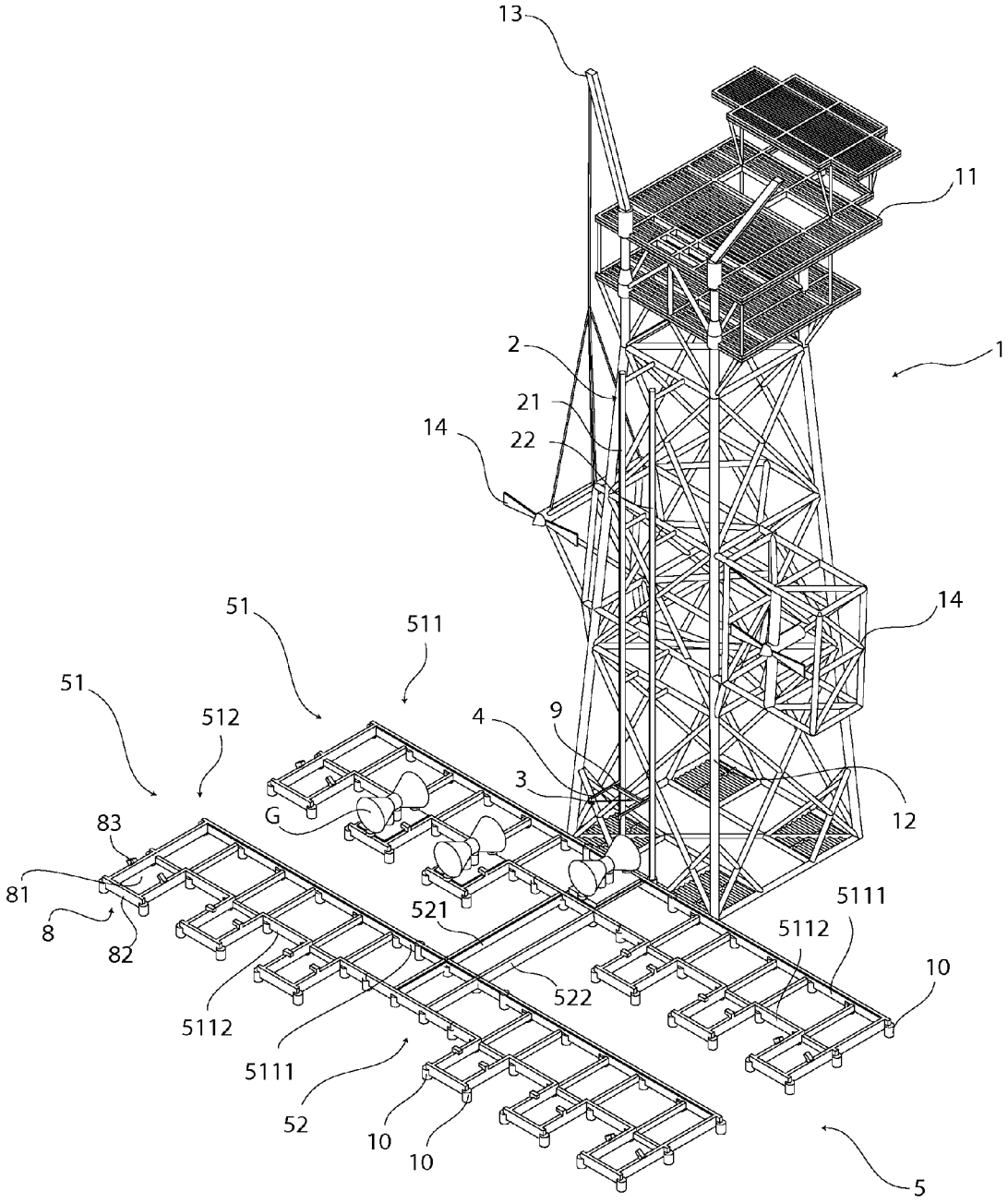
FIG. 1 is a perspective view of the present invention in the embodiment that contains turbines that are directly supported from the structure.
Figure 2:
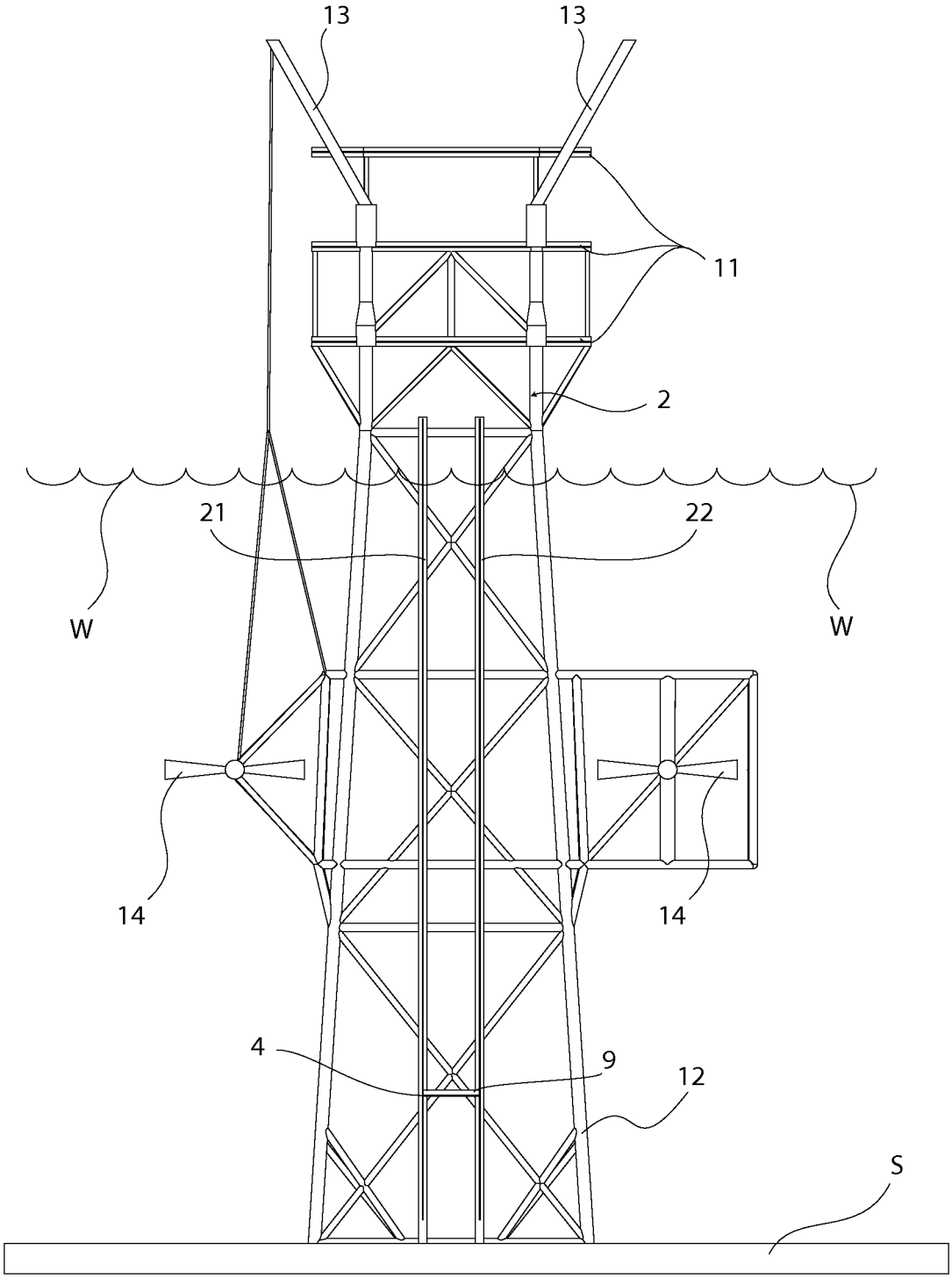
FIG. 2 is a front elevational view of only the offshore site structure and turbines mounted directly to the support structure.

In reference to FIG. 1 and FIG. 2, the marine power generator deployment and retrieval system is shown. The marine power generator deployment and retrieval system comprises an offshore site structure 1, an at least one pair of vertical guide rails 2, a vertical securing element 3, a vertical propulsion device 4, a seabed guide rail system 5, a seabed propulsion device 6, a seabed rail securing element 7, a plurality of parking spaces 8, a plurality of rail transfer elements 9, and a plurality of seabed supports 10.

The offshore site structure 1 further comprises a jacket 12, an at least one crane 13, and an at least one deck 11. The offshore site structure 1 serves as the main body of the invention that supports most of the components. At least one deck 11 will be mounted at the top of the structure, positioned in a way that creates a level surface to allow humans to perform the necessary operations for underwater electrical power generator deployment or retrieval. More than one deck can be included in the invention depending on the amount of supporting equipment needed to maintain the invention. Additionally, the deck may be used to support equipment necessary to transmit power from the generators to a land-based power plant. The jacket 12 of the offshore site structure 1 lies underwater on a seabed S and provides a sturdy foundation for the entire structure. The ideal seabed would be completely flat however that is not always the case. The jacket 12 may be altered to suit the underwater terrain. At least one crane 13 will be positioned on one of at least one deck 11, angly extending into the air and will serve to lift an underwater electrical power generator G off of transport barges and onto one of the decks and vice versa. At least one crane 13 may also be used to lift the underwater electrical power generator G directly on to the vertical propulsion device 4.

In reference to FIG. 1, at least one pair of vertical guide rails 2 is shown attached to a lateral face of the offshore site structure 1 and includes a left vertical guide rail 21 and a right vertical guide rail 22 and are positioned parallel to each other. The pair of vertical guide rails 2 is attached to a lateral face of the offshore site structure 1 and extends from above a waterline W all the way down to the base of the jacket 12 and serves to guide the vertical propulsion device 4 in the vertical direction during deployment and retrieval. The present invention will allow users to attach underwater electrical power generators onto the vertical propulsion device 4. The vertical propulsion device 4 is engaged on the pair of vertical guide rails 2 and serves as means to move an underwater electrical power generator G up and down the vertical guide rails. Underwater electrical power generators need to be safely attached to the vertical propulsion device 4 and that is achieved by the use of the vertical securing element 3. The vertical securing element 3 is attached to the vertical propulsion device 4 and secures the underwater electrical power generator G to the vertical propulsion device 4 to prevent said underwater electrical power generator G from detaching. One of the plurality of rail transfer elements 9 is attached to the vertical propulsion device 4. This device is used as means to transfer the underwater electrical power generator G from the vertical propulsion device 4 and onto the seabed propulsion device 6.

Figure 3:
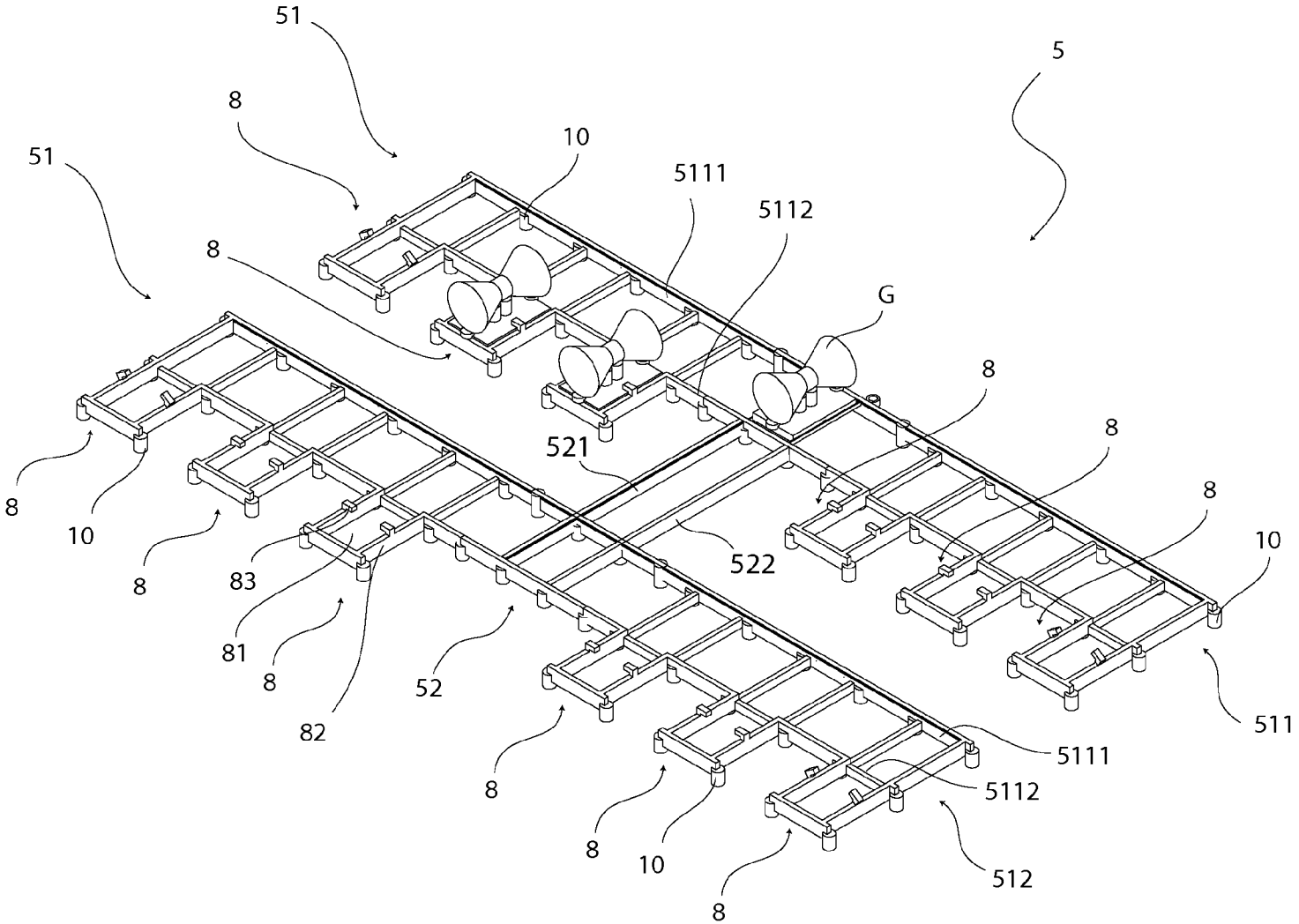
FIG. 3 is a perspective view of the seabed guide rail system and parking spaces.
Figure 5:
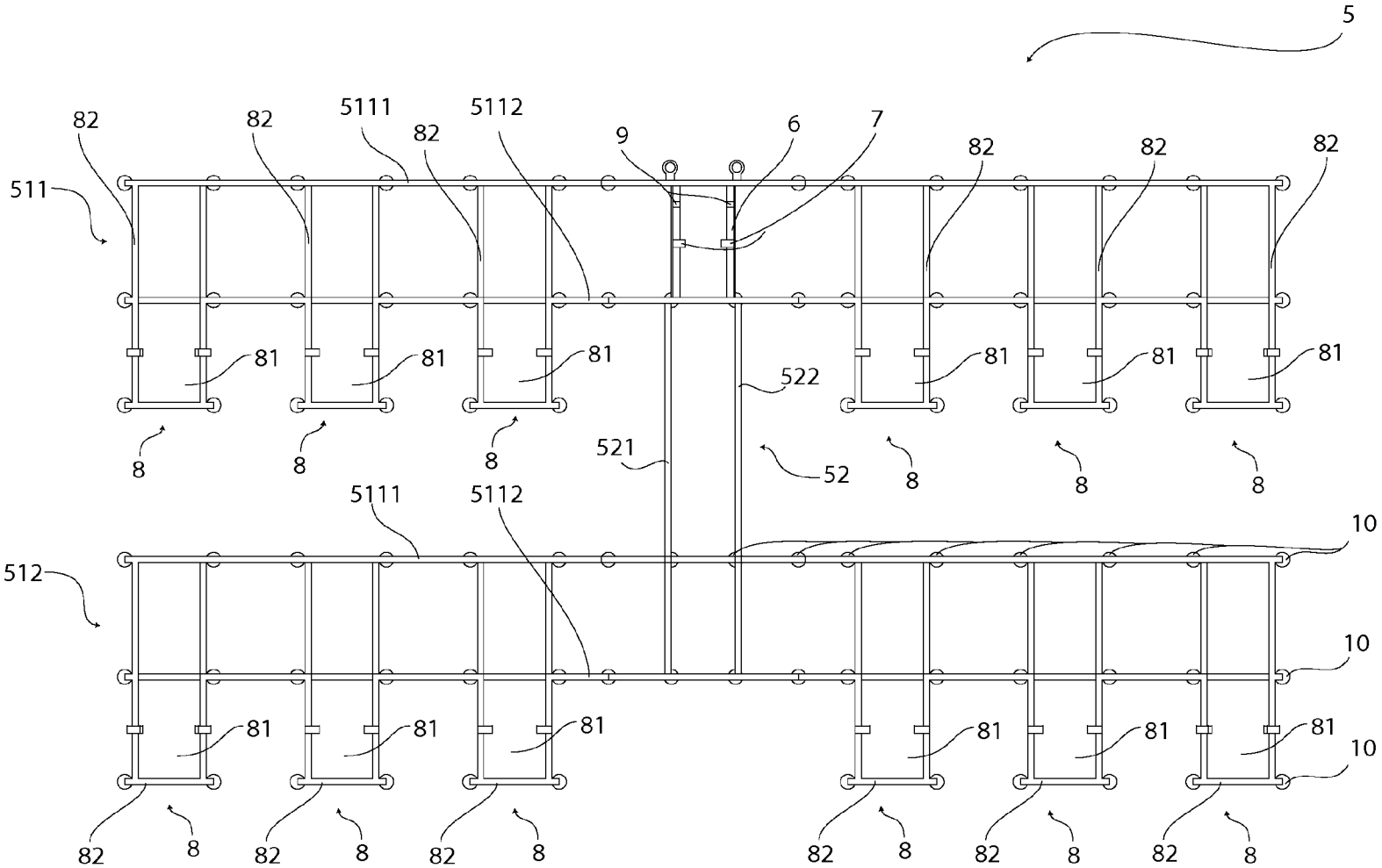
FIG. 5 is a top plan view of the seabed guide rail system and parking spaces.

In reference to FIG. 3 and FIG. 5, the seabed guide rail system 5 is shown on a seabed S. The seabed guide rail system 5 further comprises an at least one pair of horizontal guide rails 51 and a pair of interconnecting seabed rails 52. In reference to FIG. 5, at least one pair of horizontal guide rails 51 further comprises a first pair of horizontal guide rails 511 and a second pair of horizontal guide rails 512. Each of the pairs of horizontal guide rails further comprises a first horizontal guide rail 5111 and a second horizontal guide rail 5112 and are positioned parallel to each other. The pair of interconnecting seabed rails further comprises a left interconnecting seabed rail 521 and a right interconnecting seabed rail 522. Each pair of horizontal guide rails are linked together through the pair of interconnecting seabed rails 52 and are positioned parallel to each other. The pair of interconnecting seabed rails 52 is perpendicularly positioned to each pair of horizontal guide rails and traverses through the first pair of horizontal guide rails 511 and the second pair of horizontal guide rails 512. The pair of interconnecting seabed rails 52 acts as a bridge between the pairs of horizontal guide rails, allowing the seabed propulsion device 6 to move from one pair of horizontal guide rails to another. Depending on the number of the pair of horizontal guide rails, the length of the pair of interconnecting seabed rails 52 can be adjusted. These rails create a network of pathways to transport underwater electrical power generators to their specific parking space and are resilient enough to withstand the stresses of marine environments. To stabilize the seabed guide rail system 5 and the pair of interconnecting seabed rails 52, each pair of horizontal guide rails and interconnecting rails are mounted the plurality of seabed supports 10. The seabed supports 10 are spaced evenly throughout the rails to ensure an even weight distribution. Since the seabed S is not always ideal for structures, the plurality of seabed supports 10 serves as a stable foundation for the seabed guide rail system 5. Although only two rows of the pair of horizontal guide rails are shown in FIG. 1, FIG. 3, and FIG. 5, it is understood that the user may choose to implement as many rows as possible as allowed.

Figure 4:
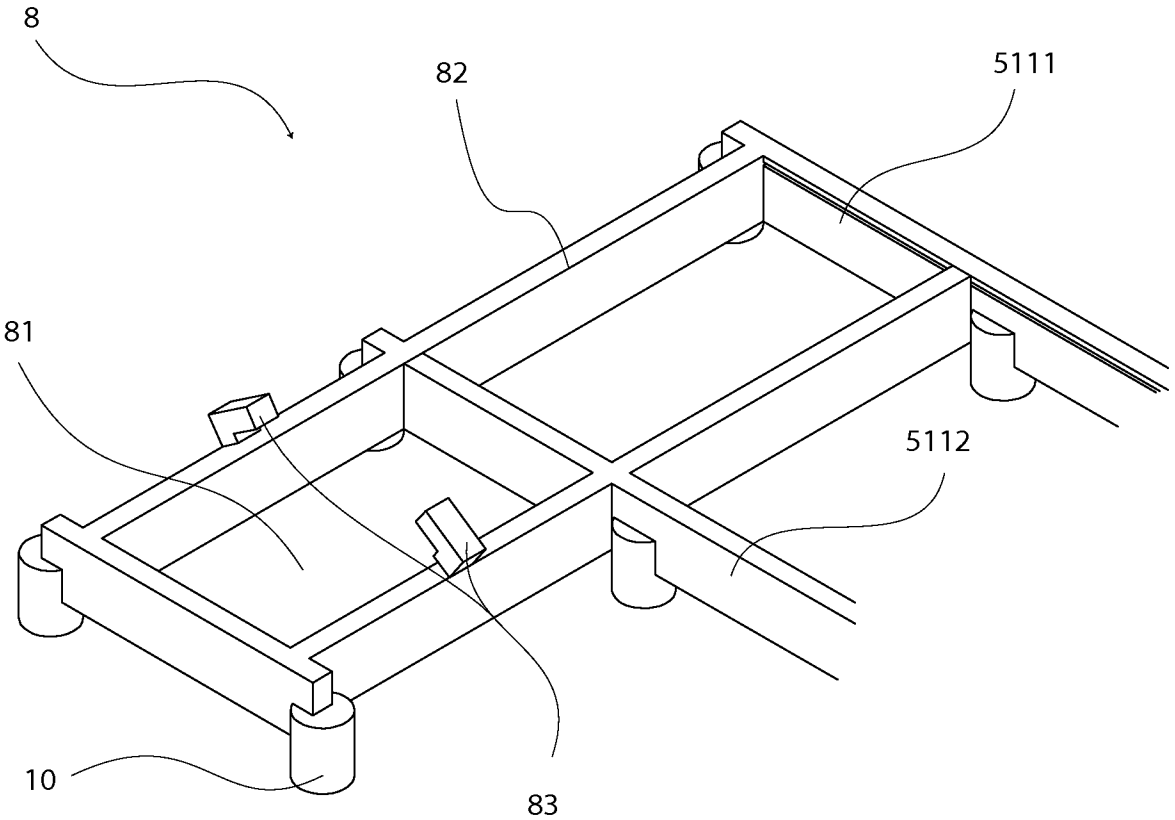
FIG. 4 is a perspective view of a single parking space and its various components.

In reference to FIG. 4, one of the plurality of parking spaces 8 is shown. Each of the plurality of parking spaces 8 further comprises a parking space frame 82 and a parking space securing element. The parking space frame 82 is formed in a U-shape with the open end perpendicularly connecting to the first horizontal guide rail 5111 of at least one pair of horizontal guide rails 51. Furthermore, the legs of the parking space frame 82 traverse through the second horizontal guide. The legs of the parking space frame 82 and the second horizontal guide create a recessed space 81; the recessed space 81 receives the underwater electrical power generator G. The legs of the parking space frame 82 are formed so that they also act as guide rails to allow the seabed propulsion device 6 to engage. The parking space securing element is mounted on top of the parking space frame 82 and securely engages the underwater electrical power generator G, prohibiting movement. Each of the plurality of parking spaces 8 is placed at a substantial distance from one another so that underwater electrical power generators can be installed and removed without disturbing each other. Similar to the seabed guide rail system 5, the plurality of seabed supports 10 is also connected to the bottoms of each of the plurality of parking spaces 8. The underwater electrical power generators will be able to transport electricity via underwater cables either to a junction on the deck of the offshore site or directly onto land. Furthermore, sensors may be installed within the parking spaces monitor each underwater electrical power generator. Although only six parking spaces are shown per pair of horizontal guide rails in FIG. 1, FIG. 3, and FIG. 5, it is understood that the user may choose to implement as many parking spaces as allowed.

Figure 6:
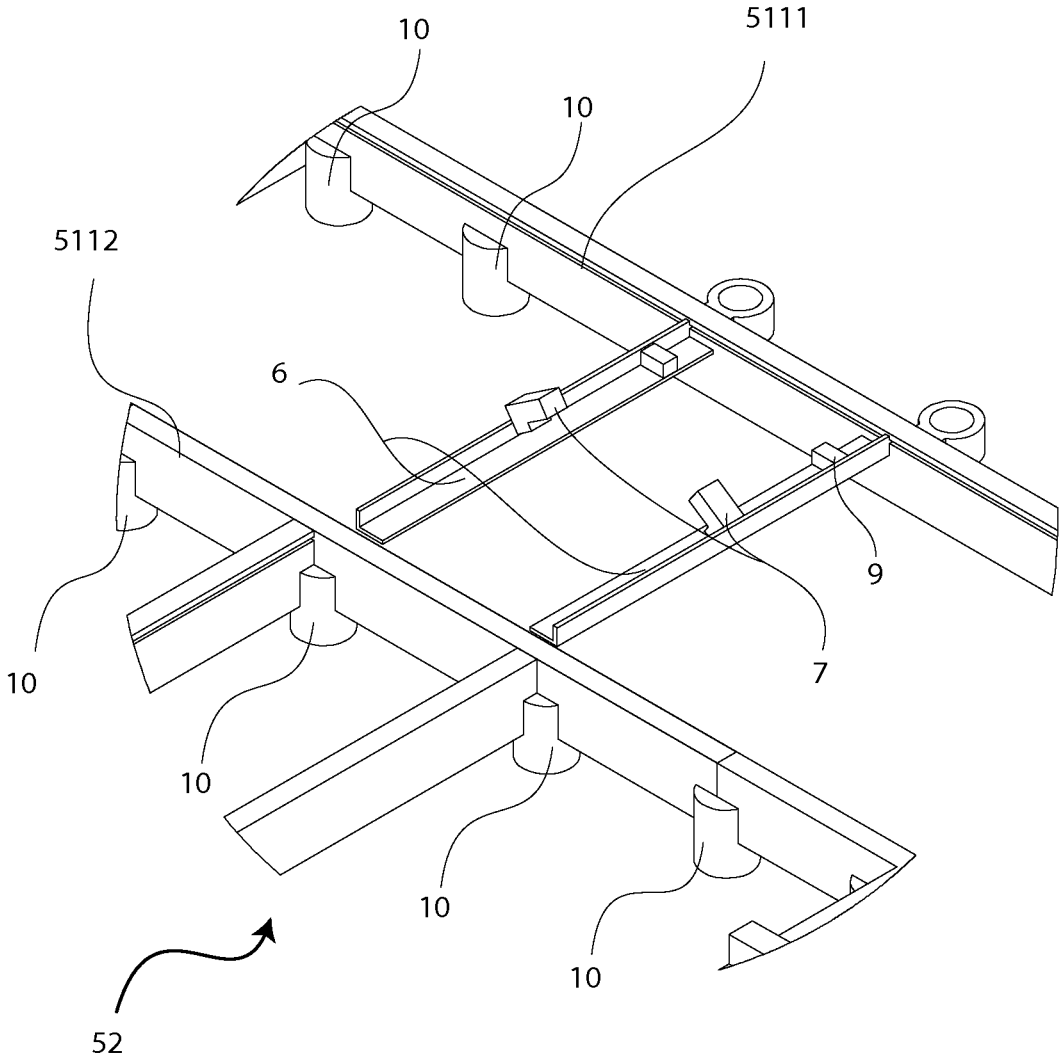
FIG. 6 is a close up view of the seabed propulsion device for a better view of various components.

In reference to FIG. 6, the seabed propulsion device 6 is shown engaged on the first pair of horizontal guide rails 511. The seabed propulsion device 6 can move along the pairs of horizontal guide rails and the pair of interconnecting seabed rails 52 and into each of the plurality of parking spaces 8. At least one pair of horizontal guide rails 51, the pair of interconnecting seabed rails 52, and the legs of the parking space frame 82 all serve as a track for the seabed propulsion device 6. The seabed rail securing element 7 is attached on the seabed propulsion device 6 and secures the underwater electrical power generator G to the driveway propulsion device. Another one of the plurality of transfer elements is attached to the seabed propulsion device 6. The transfer element is attached to the seabed propulsion device 6 and therefore is used to transfer the underwater electrical power generator G onto a parking space or onto the vertical propulsion device 4 depending on if the present invention is deploying or retrieving the underwater electrical power generator G.

To gain a better understanding of the present invention, the operation of the marine power generator deployment and retrieval system is described as follows. At least one crane 13 lifts the underwater electrical power generator G and sets said underwater electrical power generator onto the vertical propulsion device 4. The vertical securing element 3 engages the underwater electrical power generator G to prevent said underwater electrical power generator from detaching from the vertical propulsion device 4. The vertical propulsion device 4 then transports the underwater electrical power generator G down the pair of vertical guide rails 2. Once the vertical propulsion device 4 reaches the bottom of the vertical guide rails, the vertical securing element 3 disengages from the underwater electrical power generator G. One of the plurality of rail transfer elements 9 is used as means to relocate the underwater electrical power generator G from the vertical propulsion device 4 and onto the seabed propulsion device 6. The seabed rail securing element 7 securely engages the underwater electrical power generator G. At this point, the seabed propulsion device 6 may move to one of the plurality of parking spaces 8, travelling on the pair of horizontal guide rails. The seabed propulsion device 6 can reach different pairs of horizontal guide rails via the pair of interconnecting seabed rails 52. After reaching the desired parking space, the seabed propulsion device 6 halts and disengages the seabed rail securing element 7. A different one of the plurality of rail transfer elements 9 relocates the underwater electrical power generator G from the seabed propulsion device 6 and into the recessed area of the parking space. Finally, the parking space securing element secures the underwater electrical power generator G in the recessed space 81. The seabed propulsion device 6 then returns to its default position on the seabed rail system. Usually, the default position is at the bottom of the pair of vertical guide rails 2, ready to receive the next underwater electrical power generator G. The present invention can also retrieve underwater electrical power generators from the seabed S.

Another embodiment of the present invention increases the extraction of energy by attaching an at least one turbine 14 is mounted underwater on different lateral faces of the offshore site structure 1. Supporting equipment will be connected to each turbine and be used to monitor the activity of each turbine.

Although the invention has been explained in relation to its preferred embodiment, it is to be understood that many other possible modifications and variations can be made without departing from the spirit and scope of the invention as hereinafter claimed.

What is claimed is:

1. A marine power generator deployment and retrieval system, comprising, an offshore site structure;

at least one pair of vertical guide rails;

a vertical securing element;

a vertical propulsion device;

a seabed guide rail system;

a seabed propulsion device;

a seabed rail securing element;

a plurality of parking spaces;

a plurality of rail transfer elements;

the seabed guide rail system further comprises at least one pair of horizontal guide rails and a pair of interconnecting seabed rails;

the at least one pair of vertical guide rails being mounted to a lateral face of the offshore site structure and extending from a seabed of a body of water to above the waterline of the body of water;

the seabed guide rail system being underwater and connected to the bottom of the lateral face shared by the at least one pair of vertical guide rails;

the seabed guide rail system being perpendicularly attached to the at least one pair of vertical guide rails on the seabed of the body of water;

the plurality of parking spaces laying on the seabed of the body of water and each being perpendicularly connected to the at least one pair of horizontal guide rails;

the vertical propulsion device being engaged to the at least one pair of vertical guide rails and is able to move upwards and downwards along the at least one pair of vertical guide rails;

the seabed propulsion device being engaged to the seabed guide rail system and allowed to travel along the at least one pair of horizontal guide rails and the pair of interconnecting seabed rails; and the plurality of rail transfer elements being positioned on both the vertical propulsion device and the seabed propulsion device.

2. The marine power generator deployment and retrieval system as claimed in claim 1, comprising, the offshore site structure further comprises at least one deck, at least one jacket, and at least one crane;

the at least one jacket of the offshore site structure being positioned on a seabed and the offshore site structure extending vertically upward to above a waterline;

the at least one deck being connected on top of the offshore site structure above the waterline and being parallel to the seabed; and the at least one crane being mounted on top of at least one deck and extending upwards.

3. The marine power generator deployment and retrieval system as claimed in claim 1, comprising, the at least one pair of vertical guide rails further comprises a left vertical guide rail and a right vertical guide rail;

the right vertical guide rail and the left vertical guide rail positioned in parallel to each other on the lateral face of the offshore site structure; and the right vertical guide rail and the left vertical guide rail being attached to the lateral face of the offshore site structure and extending vertically from the seabed to above the waterline.

4. The marine power generator deployment and retrieval system as claimed in claim 3, comprising, the vertical propulsion device being engaged to both the right vertical guide rail and the left vertical guide rail; and the vertical securing element being attached to the vertical propulsion device.

5. A marine power generator deployment and retrieval system as claimed in claim 1, comprising, the at least one pair of horizontal guide rails further comprises a first pair of horizontal guide rails, a second pair of horizontal guide rails, and a plurality of seabed supports;

both the first and second pair of horizontal guide rails and the pair of interconnecting seabed rails being connected on top of the plurality of seabed supports with the seabed supports being firmly planted into the seabed;

the first pair of horizontal guide rails being attached to at least one jacket of the offshore site structure; and the pair of interconnecting seabed rails being perpendicularly connected to the first pair of horizontal guide rails and the second pair of horizontal guide rails.

6. The marine power generator deployment and retrieval system as claimed in claim 5, comprising, both the first and second pair of horizontal guide rails further comprises a first horizontal guide rail and a second horizontal guide rail;

the pair of interconnecting seabed rails with one end being perpendicularly connected to the first horizontal guide rail of the first pair of horizontal guide rails; and the pair of interconnecting seabed rails with the opposite end being perpendicularly connected to the second horizontal guide rail of the second pair of horizontal guide rails.

7. The marine power generator deployment and retrieval system as claimed in claim 5, comprising, the seabed rail securing element being attached to the seabed propulsion device; and the seabed propulsion device being able to access the at least one pair of horizontal guide rails via the pair of interconnecting seabed rails.

8. The marine power generator deployment and retrieval system as claimed in claim 1, comprising, each of the plurality of parking spaces further comprises a parking space frame in a form of a U-shape, a parking space securing element, and a plurality of seabed supports;

the parking space securing element being attached on top of the parking space frame; and the parking space frame being positioned on top of the plurality of seabed supports with the seabed supports being firmly planted into the seabed.

9. The marine power generator deployment and retrieval system as claimed in claim 8, comprising, the open end of the parking space frame being perpendicularly connected to a first horizontal guide rail of the at least one pair of horizontal guide rails and substantially extending past a second horizontal guide rail thereby traversing through the second horizontal guide rail.

10. The marine power generator deployment and retrieval system as claimed in claim 9, comprising, a recessed space being formed by the parking space frame and the second horizontal guide rail.

11. The marine power generator deployment and retrieval system as claimed in claim 1, comprising, at least one turbine being attached underwater to a different lateral face of the offshore site structure.

12. A marine power generator deployment and retrieval system, comprising, an offshore site structure;

at least one pair of vertical guide rails;

a vertical securing element;

a vertical propulsion device;

a seabed guide rail system;

a seabed propulsion device;

a seabed rail securing element;

a plurality of parking spaces;

a plurality of rail transfer elements;

the offshore site structure further comprises at least one deck, at least one jacket, and at least one crane;

the at least one jacket of the offshore site structure being positioned on a seabed and the offshore site structure extending vertically upward to above a waterline;

the at least one deck being connected on top of the offshore site structure above the waterline and being parallel to the seabed;

the at least one crane being mounted on top of the at least one deck and extending upwards;

the seabed guide rail system further comprises at least one pair of horizontal guide rails and a pair of interconnecting seabed rails;

the at least one pair of vertical guide rails being mounted to a lateral face of the offshore site structure and extending from the seabed of a body of water to above the waterline of the body of water;

the seabed guide rail system being underwater and connected to the bottom of the lateral face shared by the at least one pair of vertical guide rails;

the seabed guide rail system being perpendicularly attached to the at least one pair of vertical guide rails on the seabed of the body of water;

the plurality of parking spaces laying on the seabed of the body of water and each being perpendicularly connected to the at least one pair of horizontal guide rails;

the vertical propulsion device being engaged to the at least one pair of vertical guide rails and is able to move upwards and downwards along the at least one pair of vertical guide rails;

the seabed propulsion device being engaged to the seabed guide rail system and allowed to travel along the at least one pair of horizontal guide rails and the pair of interconnecting seabed rails;

the plurality of rail transfer elements being positioned on both the vertical propulsion device and the seabed propulsion device; and at least one turbine being attached underwater to a different lateral face of the offshore site structure.

13. The marine power generator deployment and retrieval system as claimed in claim 12, comprising, the at least one pair of vertical guide rails further comprises a left vertical guide rail and a right vertical guide rail;

the right vertical guide rail and the left vertical guide rail positioned in parallel to each other on the lateral face of the offshore site structure;

the right vertical guide rail and the left vertical guide rail being attached to the lateral face of the offshore site structure and extending vertically from the seabed to above the waterline;

the vertical propulsion device being engaged to both the right vertical guide and the left vertical guide; and the vertical securing element being attached to the vertical propulsion device.

14. The marine power generator deployment and retrieval system as claimed in claim 12, comprising, the at least one pair of horizontal guide rails further comprises a first pair of horizontal guide rails, a second pair of horizontal guide rails, and a plurality of seabed supports;

both the first and second pair of horizontal guide rails and the pair of interconnecting seabed rails being connected on top of the plurality of seabed supports with the seabed supports being firmly planted into the seabed;

the first pair of horizontal guide rails being attached to the at least one jacket of the offshore site structure; and the pair of interconnecting seabed rails being perpendicularly connected to the first pair of horizontal guide rails and the second pair of horizontal guide rails.

15. The marine power generator deployment and retrieval system as claimed in claim 14, comprising, both the first and second pair of horizontal guide rails further comprises a first horizontal guide rail and a second horizontal guide rail;

the pair of interconnecting seabed rails with one end being perpendicularly connected to the first horizontal guide rail of the first pair of horizontal guide rails;

the pair of interconnecting seabed rails with the opposite end being perpendicularly connected to the second horizontal guide rail of the second pair of horizontal guide rails;

the seabed rail securing element being attached to the seabed propulsion device; and the seabed propulsion device being able to access the at least one pair of horizontal guide rails via the pair of interconnecting seabed rails.

16. The marine power generator deployment and retrieval system as claimed in claim 12, comprising, each of the plurality of parking spaces further comprises a parking space frame in a form of a U-shape, a parking space securing element, and a plurality of seabed supports;

the parking space securing element being attached on top of the parking space frame; and the parking space frame being positioned on top of the plurality of seabed supports with the seabed supports being firmly planted into the seabed.

17. The marine power generator deployment and retrieval system as claimed in claim 16, comprising, the open end of the parking space frame being perpendicularly connected to a first horizontal guide rail of the at least one pair of horizontal guide rails and substantially extending past a second horizontal guide rail thereby traversing through the second horizontal guide rail; and a recessed space being formed by the parking space frame and second horizontal guide rail.

18. A marine power generator deployment and retrieval system, comprising, an offshore site structure;

at least one pair of vertical guide rails;

a vertical securing element;

a vertical propulsion device;

a seabed guide rail system;

a seabed propulsion device;

a seabed rail securing element;

a plurality of parking spaces;

a plurality of rail transfer elements;

the offshore site structure further comprises at least one deck, at least one jacket, and at least one crane;

the at least one jacket of the offshore site structure being positioned on a seabed and the offshore site structure extending vertically upward to above a waterline;

the at least one deck being connected on top of the offshore site structure above the waterline and being parallel to the seabed;

the at least one crane being mounted on top of the at least one deck and extending upwards;

the at least one pair of vertical guide rails further comprises a left vertical guide rail and a right vertical guide rail;

the right vertical guide rail and the left vertical guide rail positioned in parallel to each other on the lateral face of the offshore site structure;

the right vertical guide rail and the left vertical guide rail being attached to the lateral face of the offshore site structure and extending vertically from the seabed to above the waterline;

the vertical propulsion device being engaged to both the right vertical guide and the left vertical guide;

the vertical securing element being attached to the vertical propulsion device;

the seabed guide rail system further comprises at least one pair of horizontal guide rails and a pair of interconnecting seabed rails;

the at least one pair of vertical guide rails being mounted to a lateral face of the offshore site structure and extending from a seabed of a body of water to above the waterline of the body of water;

the seabed guide rail system being underwater and connected to the bottom of the lateral face shared by the at least one pair of vertical guide rails;

the seabed guide rail system being perpendicularly attached to the at least one pair of vertical guide rails on the seabed of the body of water;

the plurality of parking spaces laying on the seabed of the body of water and each being perpendicularly connected to the at least one pair of horizontal guide rails;

the vertical propulsion device being engaged to the at least one pair of vertical guide rails and is able to move upwards and downwards along the at least one pair of vertical guide rails;

the seabed propulsion device being engaged to the seabed guide rail system and allowed to travel along the at least one pair of horizontal guide rails and the pair of interconnecting seabed rails;

the plurality of rail transfer elements being positioned on both the vertical propulsion device and the seabed propulsion device; and at least one turbine being attached underwater to a different lateral face of the offshore site structure.

19. The marine power generator deployment and retrieval system as claimed in claim 18, comprising, the at least one pair of horizontal guide rails further comprises a first pair of horizontal guide rails, a second pair of horizontal guide rails, and a plurality of seabed supports;

both the first and second pair of horizontal guide rails and the pair of interconnecting seabed rails being connected on top of the plurality of seabed supports with the seabed supports being firmly planted into the seabed;

the first pair of horizontal guide rails being attached to the at least one jacket of the offshore site structure;

the pair of interconnecting seabed rails being perpendicularly connected to the first pair of horizontal guide rails and the second pair of horizontal guide rails;

both the first and second pair of horizontal guide rails further comprises a first horizontal guide rail and a second horizontal guide rail;

the pair of interconnecting seabed rails with one end being perpendicularly connected to the first horizontal guide rail of the first pair of horizontal guide rails;

the pair of interconnecting seabed rails with the opposite end being perpendicularly connected to the second horizontal guide rail of the second pair of horizontal guide rails the seabed rail securing element being attached to the seabed propulsion device; and the seabed propulsion device being able to access the at least one pair of horizontal guide rails via the pair of interconnecting seabed rails.

20. The marine power generator deployment and retrieval system as claimed in claim 18, comprising, each of the plurality of parking spaces further comprises a parking space frame in a form of a U-shape, a parking space securing element, and a plurality of seabed supports;

the parking space securing element being attached on top of the parking space frame;

the parking space frame being positioned on top of the plurality of seabed supports with the seabed supports being firmly planted into the seabed;

the open end of the parking space frame being perpendicularly connected to the first horizontal guide rail of the at least one pair of horizontal guide rails and substantially extending past a second horizontal guide rail thereby traversing through the second horizontal guide rail; and a recessed space being formed by the parking space frame and second horizontal guide rail.

* * * * *